US009482421B2

(12) United States Patent
Negley et al.

(10) Patent No.: US 9,482,421 B2
(45) Date of Patent: Nov. 1, 2016

(54) LAMP WITH LED ARRAY AND THERMAL COUPLING MEDIUM

(75) Inventors: Gerald H. Negley, Chapel Hill, NC (US); Praneet Athalye, Morrisville, NC (US); Thomas G. Coleman, Pittsboro, NC (US)

(73) Assignee: Cree, Inc., Durham, NC (US)

( * ) Notice: Subject to any disclaimer, the term of this patent is extended or adjusted under 35 U.S.C. 154(b) by 260 days.

(21) Appl. No.: 13/340,928

(22) Filed: Dec. 30, 2011

(65) Prior Publication Data

US 2013/0170175 A1 Jul. 4, 2013

(51) Int. Cl.
*F21V 29/00* (2015.01)
*F21V 3/00* (2015.01)
(Continued)

(52) U.S. Cl.
CPC ..... *F21V 29/004* (2013.01); *F21K 9/135* (2013.01); *F21K 9/137* (2013.01); *F21K 9/56* (2013.01); *F21K 9/90* (2013.01); *F21V 3/00* (2013.01); *F21V 3/0481* (2013.01); *F21V 29/58* (2015.01); *F21V 29/006* (2013.01); *F21V 29/506* (2015.01); *F21Y 2101/02* (2013.01); *F21Y 2111/001* (2013.01); *F21Y 2113/005* (2013.01); *Y10T 29/49117* (2015.01)

(58) Field of Classification Search
CPC .... F21V 29/20; F21V 29/2293; F21V 29/30; F21V 29/24; F21V 29/248; F21K 9/10; F21K 9/135; F21K 9/13; F21K 9/56; F21K 9/50; F21Y 2101/02; F21Y 2113/005; F21Y 2113/007
USPC ..... 362/294, 373, 267
See application file for complete search history.

(56) References Cited

U.S. PATENT DOCUMENTS 3,581,162 A 5/1971 Wheatley
5,463,280 A 10/1995 Johnson
(Continued)

FOREIGN PATENT DOCUMENTS

EP 1058221 A2 12/2000
EP 0890059 B1 6/2004
(Continued)

OTHER PUBLICATIONS

Cree, Inc., International Application No. PCT/US2012/070499, International Search Report and Written Opinion, Apr. 3, 2013.
(Continued)

*Primary Examiner* — Robert May
(74) *Attorney, Agent, or Firm* — Steven B. Phillips; Moore & Van Allen PLLC

(57) ABSTRACT

A lamp with an LED array is disclosed. The centralized nature of the LEDs allows the LEDs to be configured in a filament-like way using a supporting power structure, near the central portion of the optical envelope of the lamp. In example embodiments, the LEDs are cooled by a fluid medium to enable the LEDs to maintain appropriate mechanical stability and operating temperature. In some embodiments, the lamp operates at a power of at least 5 watts. Since the LED array can be centralized to form a filament-like structure, the light pattern from the lamp is not adversely affected by the presence of a heat sink or mechanical supporting parts. In some embodiments, phosphor is used provide wavelength conversion. The phosphor can be suspended within the optically transmissive fluid medium, placed remotely in the lamp structure, or applied to unencapsulated LED die.

22 Claims, 8 Drawing Sheets

(51) Int. Cl.

| | |
|---|---|
| ***F21K 99/00*** | (2016.01) |
| ***F21V 3/04*** | (2006.01) |
| ***F21V 29/58*** | (2015.01) |
| *F21Y 101/02* | (2006.01) |
| *F21Y 111/00* | (2016.01) |
| *F21Y 113/00* | (2016.01) |
| *F21V 29/506* | (2015.01) |

(56) References Cited

U.S. PATENT DOCUMENTS

| | | | | |
|---|---|---|---|---|
| 5,561,346 | A | 10/1996 | Byrne | |
| 5,585,783 | A | 12/1996 | Hall | |
| 5,655,830 | A | 8/1997 | Ruskouski | |
| 5,688,042 | A | 11/1997 | Madadi et al. | |
| 5,806,965 | A | 9/1998 | Deese | |
| 5,890,794 | A * | 4/1999 | Abtahi et al. | 362/294 |
| 5,947,588 | A | 9/1999 | Huang | |
| 5,949,347 | A | 9/1999 | Wu | |
| 6,220,722 | B1 | 4/2001 | Begemann | |
| 6,227,679 | B1 | 5/2001 | Zhang et al. | |
| 6,234,648 | B1 | 5/2001 | Borner et al. | |
| 6,250,774 | B1 | 6/2001 | Begemann et al. | |
| 6,276,822 | B1 | 8/2001 | Bedrosian et al. | |
| 6,465,961 | B1 | 10/2002 | Cao | |
| 6,523,978 | B1 | 2/2003 | Huang | |
| 6,550,953 | B1 | 4/2003 | Ichikawa et al. | |
| 6,634,770 | B2 | 10/2003 | Cao | |
| 6,639,360 | B2 | 10/2003 | Roberts et al. | |
| 6,659,632 | B2 | 12/2003 | Chen | |
| 6,709,132 | B2 | 3/2004 | Ishibashi | |
| 6,744,194 | B2 | 6/2004 | Fukasawa et al. | |
| 6,803,607 | B1 | 10/2004 | Chan et al. | |
| 6,848,819 | B1 | 2/2005 | Arndt et al. | |
| 6,864,513 | B2 | 3/2005 | Lin et al. | |
| 6,888,173 | B2 | 5/2005 | Ishii et al. | |
| 6,948,829 | B2 | 9/2005 | Verdes et al. | |
| 6,982,518 | B2 | 1/2006 | Chou et al. | |
| 7,048,412 | B2 | 5/2006 | Martin et al. | |
| 7,063,996 | B2 | 6/2006 | Ishii et al. | |
| 7,080,924 | B2 | 7/2006 | Tseng et al. | |
| 7,086,756 | B2 | 8/2006 | Maxik | |
| 7,086,767 | B2 | 8/2006 | Sidwell et al. | |
| 7,141,442 | B2 | 11/2006 | Sano | |
| 7,144,135 | B2 | 12/2006 | Martin et al. | |
| 7,165,866 | B2 | 1/2007 | Li | |
| 7,172,314 | B2 | 2/2007 | Currie et al. | |
| 7,210,832 | B2 * | 5/2007 | Huang | 362/547 |
| 7,213,940 | B1 | 5/2007 | Van De Ven et al. | |
| 7,354,174 | B1 | 4/2008 | Yan | |
| 7,396,142 | B2 | 7/2008 | Laizure, Jr. et al. | |
| 7,564,180 | B2 * | 7/2009 | Brandes | C09K 11/586 257/89 |
| 7,588,351 | B2 * | 9/2009 | Meyer | 362/294 |
| 7,600,882 | B1 | 10/2009 | Morejon et al. | |
| 7,726,836 | B2 | 6/2010 | Chen | |
| 7,824,065 | B2 | 11/2010 | Maxik | |
| 7,997,750 | B2 * | 8/2011 | Chiang | 362/101 |
| 8,008,845 | B2 | 8/2011 | Van De Ven et al. | |
| 8,021,025 | B2 | 9/2011 | Lee | |
| 8,253,316 | B2 | 8/2012 | Sun et al. | |
| 8,272,762 | B2 | 9/2012 | Maxik et al. | |
| 8,272,766 | B2 * | 9/2012 | Phipps et al. | 362/294 |
| 8,274,241 | B2 | 9/2012 | Guest et al. | |
| 8,277,082 | B2 | 10/2012 | Dassanayake et al. | |
| 8,282,250 | B1 | 10/2012 | Dassanayake et al. | |
| 8,292,468 | B2 | 10/2012 | Narendran et al. | |
| 8,322,896 | B2 * | 12/2012 | Falicoff et al. | 362/363 |
| 8,337,048 | B2 * | 12/2012 | Shen | 362/267 |
| 8,371,722 | B2 | 2/2013 | Carroll | |
| 8,400,051 | B2 | 3/2013 | Hakata et al. | |
| 8,415,865 | B2 | 4/2013 | Liang et al. | |
| 8,421,320 | B2 | 4/2013 | Chuang | |
| 8,421,321 | B2 | 4/2013 | Chuang | |
| 8,421,322 | B2 | 4/2013 | Carroll et al. | |
| 8,449,154 | B2 | 5/2013 | Uemoto et al. | |
| 8,502,468 | B2 | 8/2013 | Li et al. | |
| 8,641,237 | B2 | 2/2014 | Chuang | |
| 8,653,723 | B2 | 2/2014 | Cao et al. | |
| 8,684,564 | B2 * | 4/2014 | Shen | F21K 9/135 257/714 |
| 8,696,168 | B2 | 4/2014 | Li et al. | |
| 8,740,415 | B2 | 6/2014 | Wheelock | |
| 8,750,671 | B1 | 6/2014 | Kelly et al. | |
| 8,752,984 | B2 | 6/2014 | Lenk et al. | |
| 8,760,042 | B2 | 6/2014 | Sakai et al. | |
| 2004/0201990 | A1 | 10/2004 | Meyer | |
| 2007/0267976 | A1 | 11/2007 | Bohler et al. | |
| 2008/0253125 | A1 * | 10/2008 | Kang et al. | 362/294 |
| 2009/0001372 | A1 * | 1/2009 | Arik et al. | 257/58 |
| 2009/0184618 | A1 | 7/2009 | Hakata et al. | |
| 2010/0109551 | A1 | 5/2010 | Shen | |
| 2010/0177522 | A1 * | 7/2010 | Lee | 362/373 |
| 2010/0219734 | A1 * | 9/2010 | Lenk | 313/35 |
| 2011/0074270 | A1 | 3/2011 | Van De Ven et al. | |
| 2011/0074296 | A1 | 3/2011 | Shen et al. | |
| 2011/0176316 | A1 | 7/2011 | Phipps et al. | |
| 2011/0193479 | A1 | 8/2011 | Nilssen et al. | |
| 2012/0040585 | A1 | 2/2012 | Huang | |
| 2012/0155059 | A1 * | 6/2012 | Hoelen et al. | 362/84 |

FOREIGN PATENT DOCUMENTS

| | | | | |
|---|---|---|---|---|
| EP | 2108880 | A2 | 10/2009 | |
| FR | 2926947 | A1 * | 7/2009 | F21V 29/004 |
| GB | 2345954 | A | 7/2000 | |
| JP | H09265807 | A | 10/1997 | |
| JP | 2000173304 | A | 6/2000 | |
| JP | 2001118403 | A | 4/2001 | |
| JP | 2007059930 | A | 3/2007 | |
| JP | 2008288183 | A | 11/2008 | |
| JP | 2009117346 | A | 5/2009 | |
| JP | 3153766 | U | 9/2009 | |
| JP | 2009277586 | A | 11/2009 | |
| TW | 201111692 | A | 4/2011 | |
| WO | 0124583 | A1 | 4/2001 | |
| WO | 0160119 | A2 | 8/2001 | |
| WO | 2007130359 | A2 | 11/2007 | |
| WO | WO 2008154172 | A1 * | 12/2008 | |
| WO | 2011097486 | A2 | 8/2011 | |
| WO | 2011109093 | A1 | 9/2011 | |
| WO | 2012011279 | A1 | 1/2012 | |
| WO | 2012031533 | A1 | 3/2012 | |

OTHER PUBLICATIONS 3M, 3M Fluorinert Electronic Liquids, http://solutions.3m.conn/wps/porta1/3M/en_US/ElectronicsChemicals/Home/Products/ElectronicLiquids/, accessed Dec. 6, 2011.

U.S. Appl. No. 13/235,103, filed Sep. 16, 2011.

U.S. Appl. No. 13/235,127, filed Sep. 16, 2011.

Chinese Patent Office; Chinese Office Action for Chinese Application No. 201280071001.4 dated Jun. 19, 2015, 13 Pages.

* cited by examiner

LAMP WITH LED ARRAY AND THERMAL COUPLING MEDIUM

Light emitting diode (LED) lighting systems are becoming more prevalent as replacements for existing lighting systems. LED systems are an example of solid state lighting (SSL) and have advantages over traditional lighting solutions such as incandescent and fluorescent lighting because they use less energy, are more durable, operate longer, can be combined in multi-color arrays that can be controlled to deliver virtually any color light, and generally contain no lead or mercury. A solid state lighting system may take the form of a lighting unit, light fixture, light bulb, or a "lamp."

An LED lighting system may include, for example, a packaged light emitting device including one or more light emitting diodes (LEDs), which may include inorganic LEDs, which may include semiconductor layers forming p-n junctions and/or organic LEDs (OLEDs), which may include organic light emission layers. Light perceived as white or near-white may be generated by a combination of red, green, and blue ("RGB") LEDs. Output color of such a device may be altered by separately adjusting supply of current to the red, green, and blue LEDs. Another method for generating white or near-white light is by using a lumiphor such as a phosphor. Still another approach for producing white light is to stimulate phosphors or dyes of multiple colors with an LED source. Many other approaches can be taken.

An LED lamp may be made with a form factor that allows it to replace a standard incandescent bulb, or any of various types of fluorescent lamps. LED lamps often include some type of optical element or elements to allow for localized mixing of colors, collimate light, or provide a particular light pattern. Sometimes the optical element also serves as an envelope or enclosure for the electronics and or the LEDs in the lamp.

Since, ideally, an LED lamp designed as a replacement for a traditional incandescent or fluorescent light source needs to be self-contained; a power supply is included in the lamp structure along with the LEDs or LED packages and the optical components. A heatsink is also often needed to cool the LEDs and/or power supply in order to maintain appropriate operating temperature. The power supply and especially the heatsink can often hinder some of the light coming from the LEDs or limit LED placement. Depending on the type of traditional bulb for which the solid-state lamp is intended as a replacement, this limitation can cause the solid-state lamp to emit light in a pattern that is substantially different than the light pattern produced by the traditional light bulb.

SUMMARY

Embodiments of the present invention provide a solid-state lamp with an LED array as the light source. The LEDs can be mounted on or fixed to a supporting power structure so that dedicated mechanical and/or structural support components are not needed. In some embodiments, a driver or power supply for the LEDs may also be mounted on the supporting power structure. The centralized nature and minimal structural support of the LEDs allows the LEDs to be configured in a filament-like way, near the central portion of the optical envelope of the lamp. In example embodiments, the LEDs are cooled and further cushioned by an optically transmissive fluid medium to enable the LEDs to maintain an appropriate operating temperature for efficient operation and long life. With such a configuration, the lamp can also operate with a power draw of at least about five watts, though still be effectively cooled. Since the LED array can be configured to form a filament-like structure, the light pattern from the lamp is not adversely affected by the presence of a heat sink and/or mounting hardware, or by having to locate the LEDs close to the base of the lamp. In some embodiments, the power supply, also called the driver, can also be cooled by the fluid medium and the physical size of the driver can be minimized so as to not unduly interfere with the light pattern from the lamp.

A lamp according to example embodiments of the invention can include an optically transmissive enclosure and a array of LEDs disposed in the enclosure on a supporting power structure to be operable to emit light when the supporting power structure is energized. The supporting power structure can include a wire frame assembly. A fluid medium is contained in the enclosure. This fluid medium surrounds the LEDs and maintains thermal coupling with array of LEDs. The fluid medium may also maintain optical coupling with the LEDs, the enclosure, or both. The fluid medium may provide optical coupling by serving as an index-matching medium. In some embodiments, the fluid medium can be oil or some other appropriate coolant. In some embodiments a fluorinated or halogenated liquid or gel can be used.

In some embodiments, phosphor is used within or on the enclosure to provide wavelength conversion for all or a portion of the light from the LEDs. In some embodiments, the phosphor is suspended within the optically transmissive fluid medium. In some embodiments, the lamp includes an optically transmissive inner envelope around the LEDs and/or the driver, and the fluid medium can be confined within the inner envelope. The lamp may include more than one inner envelope. The fluid medium may provide optical coupling to the inner envelope. An inner envelope can include remote phosphor. In some embodiments, phosphor particles are suspended in the fluid medium of the at least one inner envelope and the space between the inner envelope and the enclosure is filled with a fluid medium without phosphor particles.

In some embodiments, a lamp includes an optically transmissive enclosure and an array of LEDs disposed in the enclosure to be operable to emit light when the array of LEDs is energized. The lamp also includes a phase change material as a fluid medium in the enclosure to provide thermal coupling to the array of LEDs. In some embodiments the phase change material provides optical coupling to the array of LEDs, the optically transmissive enclosure, or both. In some embodiments, the phase change material can be confined to, or at least partially disposed in, an inner envelope within the optically transmissive enclosure.

As discussed above, in some embodiments, a phosphor is used in the lamp. In some embodiments, the phosphor, when excited, emits light having dominant wavelength from 540 to 585 nm. In some embodiments, at least some of the LEDs or LED die, when illuminated, emit light having a dominant wavelength from 435 to 490 nm, and at least some of the LEDs or LED die, emit light, when illuminated, having a dominant wavelength from 600 to 640 nm. The phosphor, in addition to being disbursed in the fluid medium or disposed as a remote phosphor as previously described, may be associated with each of at least some of the LEDs in the LED array. A phosphor may be associated with an LED die in various ways. Such a phosphor may be encapsulated or packaged with an LED as a device. Such a phosphor may also be applied directly as a coating to at least some of the LED die, which can be operated in the fluid medium without further encapsulation.

A lamp according to some embodiments of the invention can be assembled to take the form factor of a "PAR" or "A" type incandescent lamp. Embodiments of the invention can also be used to make lamps used to replace various other standard incandescent or even standard types of fluorescent or halogen lamps. In some embodiments, the PAR or A lamp can include an Edison base connected to the driver or power supply to provide power to the lamp.

DETAILED DESCRIPTION

Figure 1:
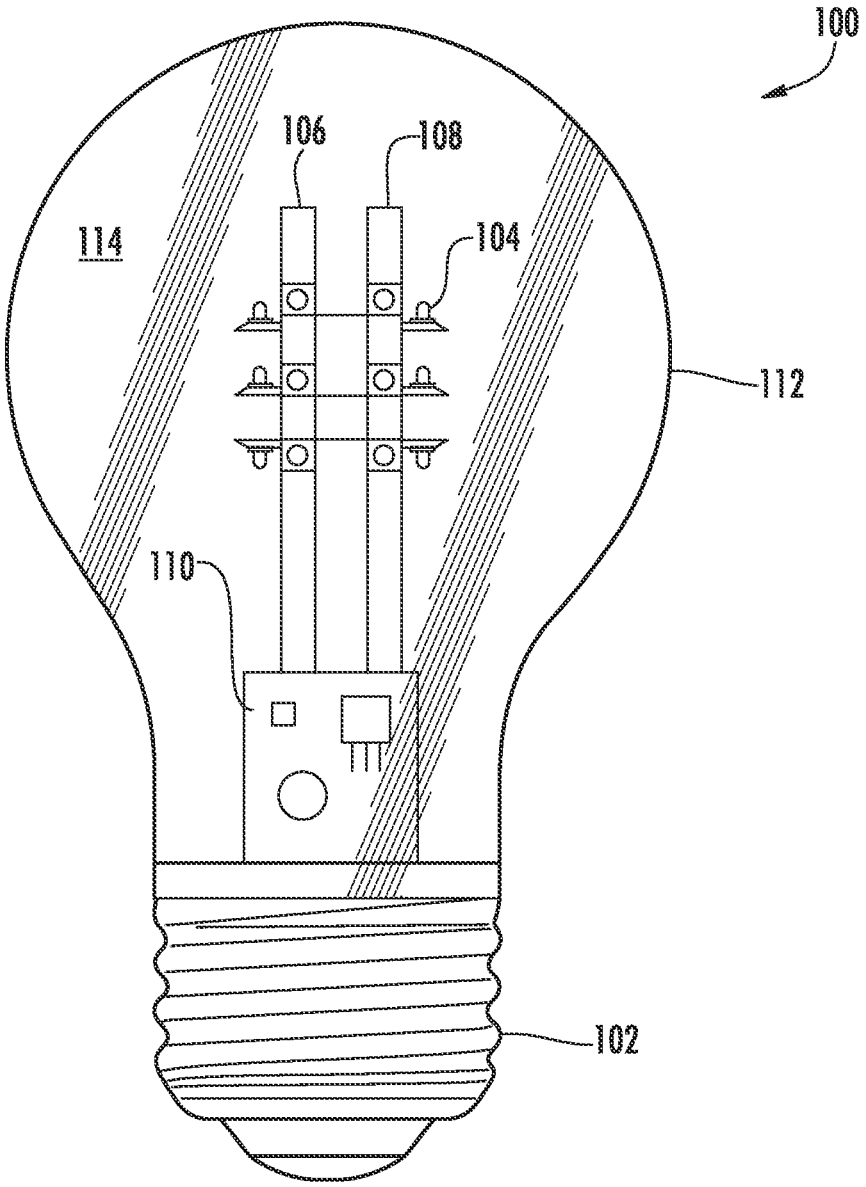
FIG. 1 is a see-through side view of a lamp according to example embodiments of the present invention. In this particular example, the lamp has the form factor of an A-series incandescent lamp.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

Embodiments of the present invention provide a solid-state lamp with centralized light emitters, more specifically, LEDs. The LEDs can be mounted on or fixed to a supporting power structure so that dedicated mechanical and/or structural support components are not needed. The centralized nature and minimal mechanical support of the LEDs allows the LEDs to be configured in a filament-like way, near the central portion of the optical envelope of the lamp. In example embodiments, the LEDs are cooled and further cushioned by an optically transmissive fluid medium to enable the LEDs to maintain appropriate operating temperatures and mechanical stability for efficient operation and long life. Since the LED array can be configured to form a filament-like structure, the light pattern from the lamp is not adversely affected by the presence of a heat sink and/or mounting hardware, or by having to locate the LEDs close to the base of the lamp. In some embodiments, the power supply can also be cooled by the fluid medium, which in part can enable the physical size of the power supply to be minimized so as to minimize the power supply's interference with the light pattern from LEDs. With the liquid-cooling described herein, a lamp can be constructed that operates at a power level of at least about five watts, while maintaining an appropriate operating temperature.

FIG. 1 shows a "see-through" side view of a lamp, 100, according to some embodiments of the present invention. Lamp 100 is an A-series lamp with an Edison base 102, more particularly; lamp 100 is designed to serve as a solid-state replacement for an A19 incandescent bulb. The LED packages 104 with their own lenses are mounted on metal strips 106 and 108 which protrude from power supply or driver 110 into optically transmissive enclosure 112. The metal strips form a supporting power structure. A supporting power structure is a structure that mechanically fixes the position of the LEDs in the array and at the same time supplies power to the LEDs with substantially no additional mechanical support, or at least a minimum of additional mechanical support for the LEDs or LED packages themselves. In some embodiments, a driver or power supply is included with the LEDs on a supporting power structure, and the structure supplies power to the driver. There may be other intervening structures or circuits. Additionally or alternatively, the LEDs may have a supporting power structure side-by-side with or added to a supporting power structure for a power supply.

Still referring to FIG. 1, enclosure 112 is, in some embodiments, a quartz enclosure. Wires run between the metal strips to carry both sides of the supply voltage to each LED package. Upward and downward facing LEDs are on metal extensions from the strips. The LEDs form a centralized LED array which is operable to emit light when energized through the metal strips. The metal strips not only support the LED array but also serve as the electrical connection to the power supply. The metal strips may also provide some heat dissipation or thermal coupling to the fluid in the lamp. The centralized LED array and the power supply for lamp 100 are cooled by an optically transmissive fluid medium 114 which fills or partially fills the optically transmissive enclosure 112.

Figure 2:
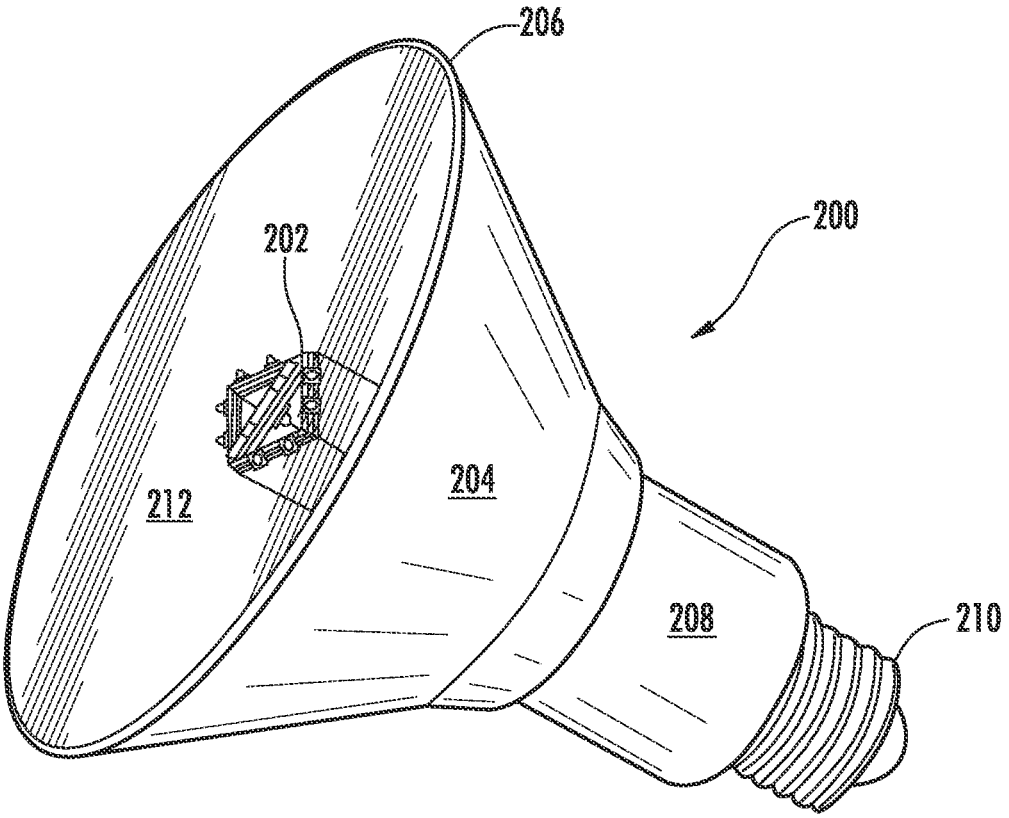
FIG. 2 is a perspective view of a lamp according to other example embodiments of the present invention. In this particular example, the lamp has the form factor of an PAR-series incandescent lamp.

FIG. 2 is a perspective view of a PAR-style lamp 200 such as a replacement for a PAR-38 incandescent bulb. Lamp 200 includes LED array 202, which can be centralized and will be discussed in further detail relative to FIG. 3. Lamp 200 also includes a reflector 204 and a glass or plastic lens 206, which covers the front of lamp 200. In this case, the power supply (not shown) can be housed in base portion 208 of lamp 200. Lamp 200 again includes an Edison base 210. Reflector 204 and lens 206 together form an optically transmissive enclosure for the lamp, albeit light transmission it this case is directional. Note that a lamp like lamp 200 could be formed with a unitary enclosure, appropriately shaped and silvered or coated on an appropriate portion to form a directional, optically transmissive enclosure. Lamp 200 includes an optically transmissive fluid medium 212 within the optically transmissive enclosure.

Figure 3:
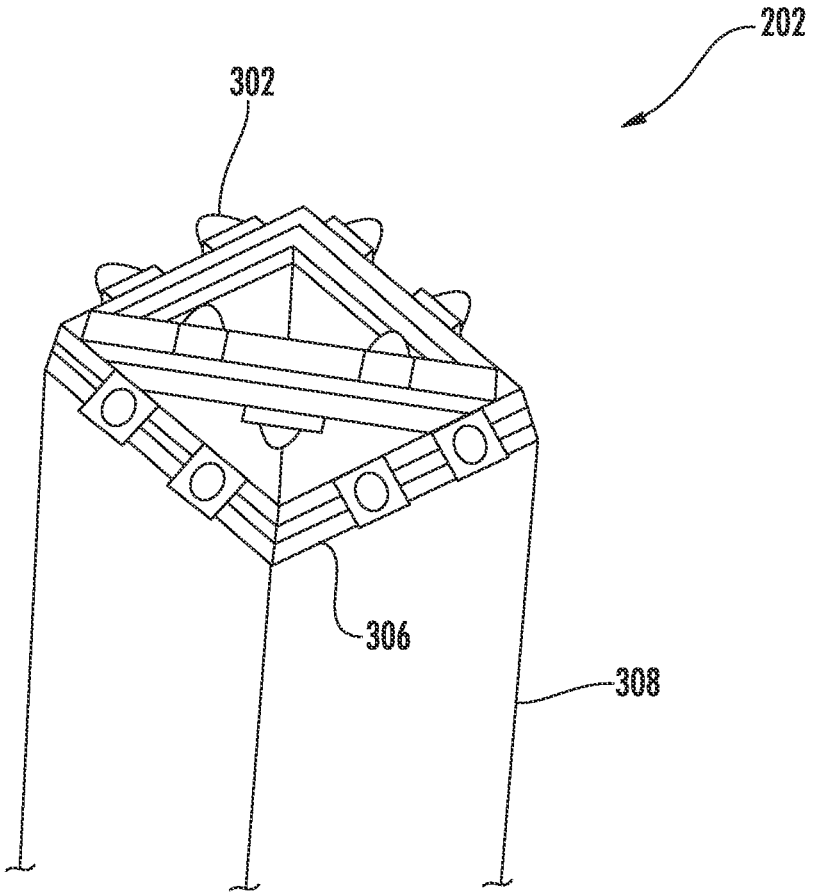
FIG. 3 is a perspective view of an LED array on a wire frame assembly that can be used with a lamp according to embodiments of the present invention.

FIG. 3 is a perspective view of the LED array 202 of lamp 200. In FIG. 3, multiple LED packages 302 are mounted on metal wires 306. A collection of metal wires used as supporting power structure or a portion of a supporting power structure may be referred to as a wire frame assembly. It should be noted that such wires have various shapes and sizes. The cross-section of such wires can be round, square, rectangular or any other shape. In this example embodiment, four electrical connection wires 308 connect the LED array to the driver and also position the LED array so that the LEDs are centralized in the enclosure in such a position that the light impinging on and reflected from the reflector and the light given off directly from LEDs through the lens produces a natural light pattern, comparable to a traditional PAR-style incandescent lamp.

Figure 4:
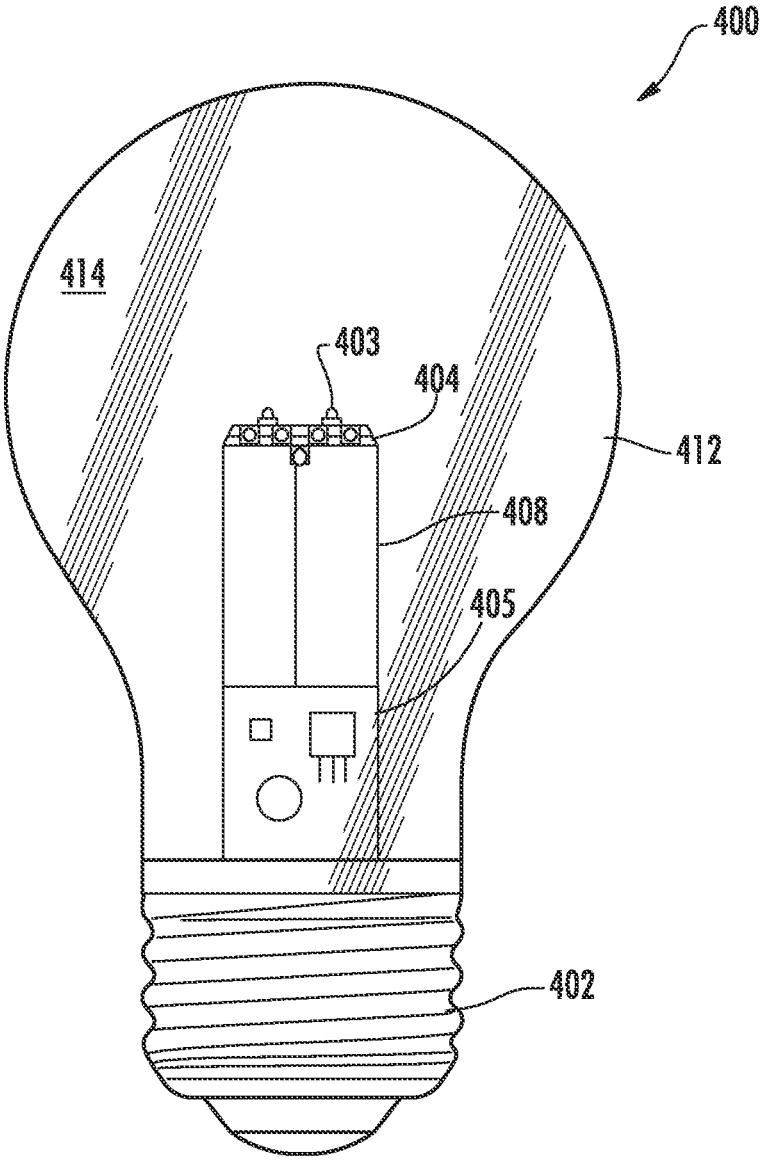
FIGS. 4-8 are see-through side views of A-type lamps according to additional embodiments of the present invention.

FIG. 4 shows a "see-through" side view of a lamp, 400, according to some embodiments of the present invention. Lamp 400 is an A-series lamp with an Edison base 402, more particularly; lamp 400 is designed to serve as a solid-state replacement for an A19 incandescent bulb. The LED packages 403 are mounted on wire frame assembly 404 which is connected to power supply or driver 405 by wires 408 in optically transmissive enclosure 412. The wire frame assembly 404 serves as a supporting power structure. Enclosure 412 is, in some embodiments, a quartz enclosure. As before, the LEDs form an LED array which is operable to emit light when the supporting power structure is energized, which in turn energizes the LEDs. The supporting power structure not only supports the LED array but also serves as the electrical connection to the power supply. The LED array and the power supply for lamp 400 are cooled by an optically transmissive fluid medium 414 which resides in the optically transmissive enclosure 412. The fluid medium may fill or partially fill the optically transmissive enclosure.

Figure 5:
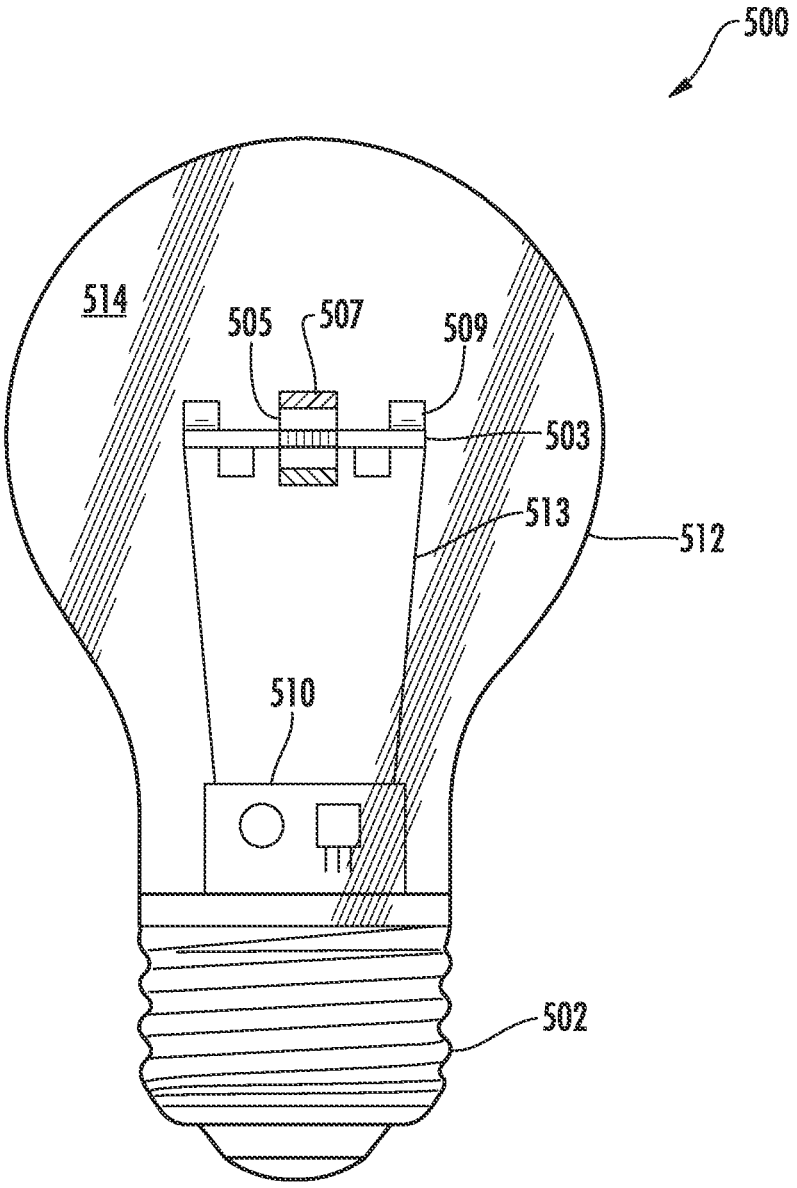

FIG. 5 shows a "see-through" side view of a lamp, 500, according to additional embodiments of the present invention. Lamp 500 is again an A-series lamp with an Edison base 502. Lamp 500 is again designed to serve as a solid-state replacement for an A19 incandescent bulb. In the case of lamp 500, the LEDs in the LED array are not packaged or encapsulated, but the die are mounted on horizontal wires 503, which form the wire frame assembly in this case. The LEDs near the center of the array include die 505 and a phosphor coating 507 on at least a portion of the die, in this case, on two sides. LEDs near the edges of the array include bare die 509. Various combinations of LEDs and phosphor can be used. In some embodiments, the die for all the LEDs might include phosphor coatings.

Still referring to FIG. 5, the LED array of lamp 500 along with power supply or driver 510 are again surrounded by an optically transmissive enclosure 512. Electrical connection wires 513 run between the wire bonds for the LEDs and driver 510 to energize the LEDs. As can be readily observed, LEDs facing various directions are included in the centralized array. As before, the centralized LED array and the power supply to lamp 500 are cooled by an optically transmissive fluid medium 514 within the optically transmissive enclosure 512.

Figure 6:
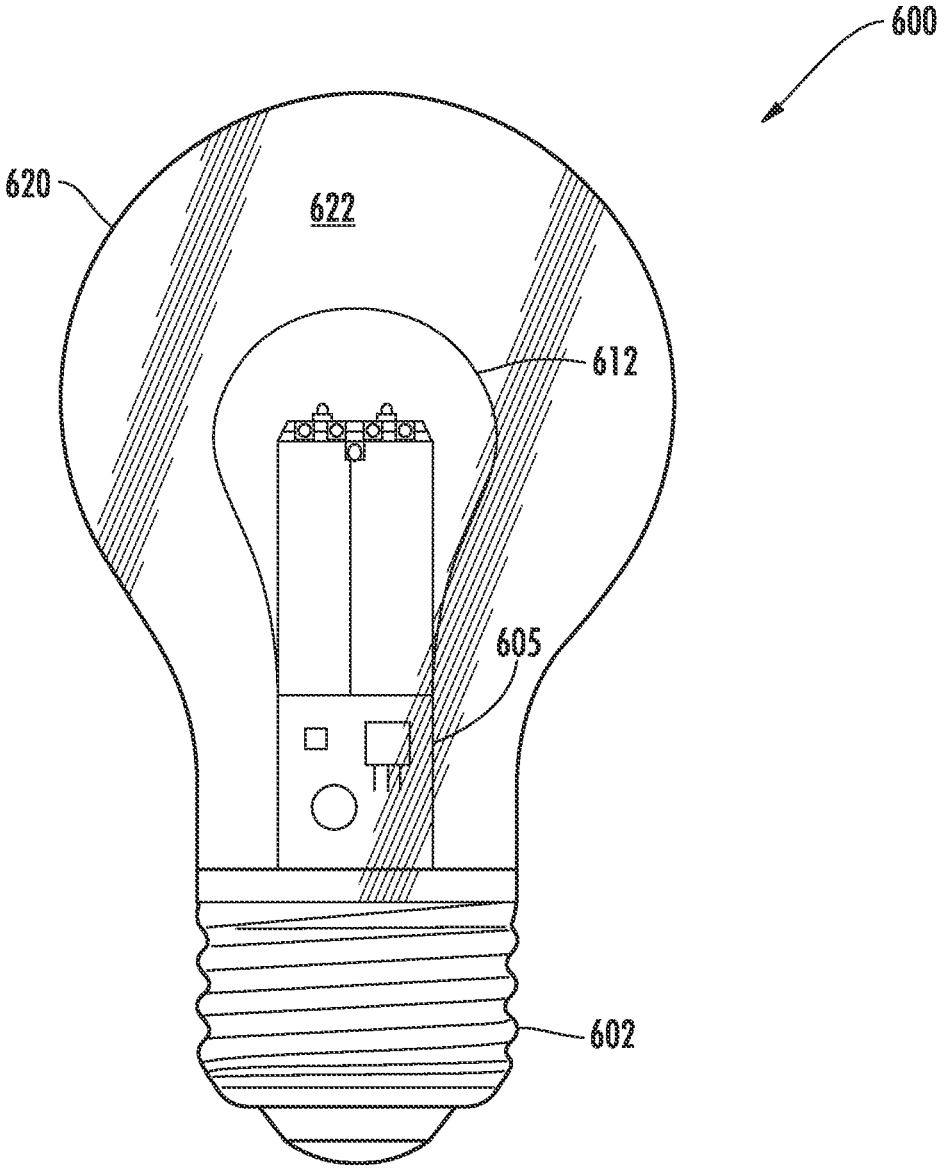

FIG. 6 shows a "see-through" side view of a lamp, 600, according to further embodiments of the present invention. Lamp 600 is again an A-series lamp with an Edison base 602. Lamp 600 includes an LED array that is similar to the LED array of FIG. 4. The LED packages are again mounted on a wire frame assembly, which is connected to power supply or driver 605 by wires optically transmissive inner envelope 612. The wire frame assembly again serves as a supporting power structure. The LED array again includes upward and downward facing LEDs. The LED array and the power supply to lamp 600 are cooled by an optically transmissive fluid medium within the optically transmissive inner envelope 616. The fluid medium may fill or partially fill the inner envelope.

Still referring to FIG. 6, lamp 600 includes an optically transmissive enclosure 620. Void 622 between the inner envelope and the optically transmissive enclosure can be substantially or partially evacuated, be filled with air or an inert gas, or can be filled or partly filled with an fluid medium having characteristics either the same or different from that of the fluid medium inside the inner envelope. It should be noted that a lamp according to embodiments of the invention may include multiple inner envelopes, which can take the form of spheres, tubes or any other shapes. Any or all of these inner envelopes could provide for index matching to optimize the volume of fluid medium needed for proper operation of the lamp. One or more of these inner envelopes could be diffusive and could be made of gels, silicone, plastic, glass or any other suitable material.

The use of an inner envelope in some embodiments allows for the lamp to contain less fluid medium and/or provide a protective enclosure that will not leak fluid should the outside of the lamp be damaged. If a lamp like lamp 600 in FIG. 6 is the same size as a lamp like that shown in FIG. 4, the structure of the LED array may need to be modified or made smaller so as to fit in the inner envelope 612 of the lamp. However in some embodiments, a lamp like that of FIG. 4 may be designed to be physically smaller than that shown in FIG. 6, for example, lamp 600 of FIG. 6 may have the size and form factor of a standard-sized household incandescent bulb, while lamp 400 of FIG. 4 may have the size and form factor of a smaller incandescent bulb, such as that commonly used in appliances. It should also be noted that in some embodiments, inner envelope 612 serves as a remote phosphor carrier, and is coated or impregnated with phosphor to provide remote wavelength conversion. It should also be noted that in this or any of the embodiments shown here, the optically transmissive enclosure or a portion of the optically transmissive enclosure can be coated or impregnated with phosphor.

Figure 7:
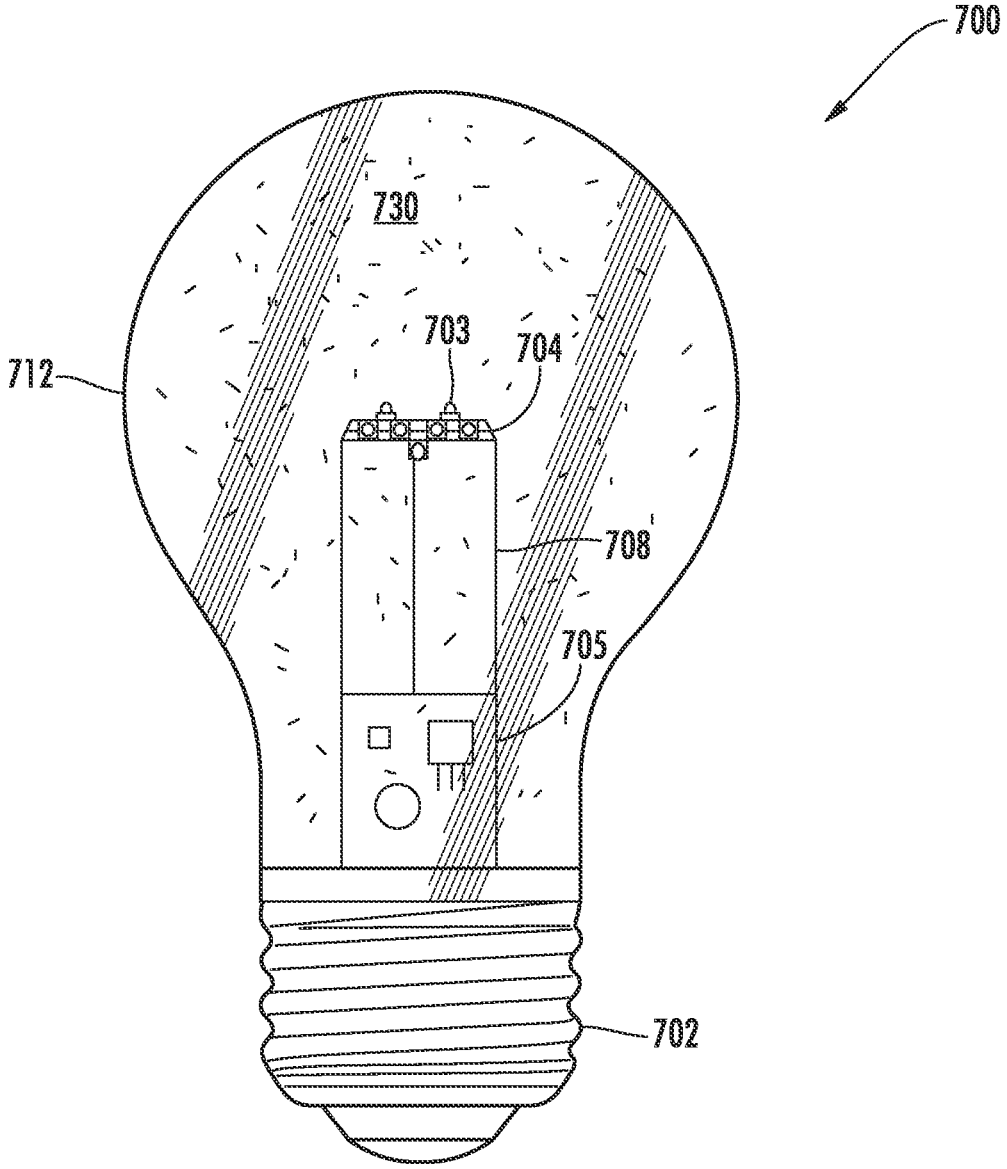

FIG. 7 shows a "see-through" side view of a lamp, 700, according to example embodiments of the invention. Lamp 700 includes an Edison base 702 and is designed to serve as a solid-state replacement for an A19 incandescent bulb. The LED packages 703 again have their own lenses, but bare die could also be used in this embodiment and in any of the embodiments disclosed herein. The LED packages are mounted on wire frame assembly 704 which is connected to power supply or driver 705 by wires 708 in optically transmissive enclosure 712. The LED array and the power supply to lamp 700 are cooled by an optically transmissive fluid medium 730 which resides in the optically transmissive enclosure 712. The embodiment of FIG. 7 differs from previous example embodiments in that fluid medium 730 includes phosphor particles disbursed and/or suspended in the fluid medium. It should be noted that phosphor particles could be disbursed in the fluid medium with any of the embodiments illustrated herein. In the embodiment of FIG. 6, fluid medium inside the inner envelope could include suspended phosphor particles while additional fluid medium between the inner envelope and the optical enclosure could be substantially free of suspended phosphor, or vice versa.

Figure 8:
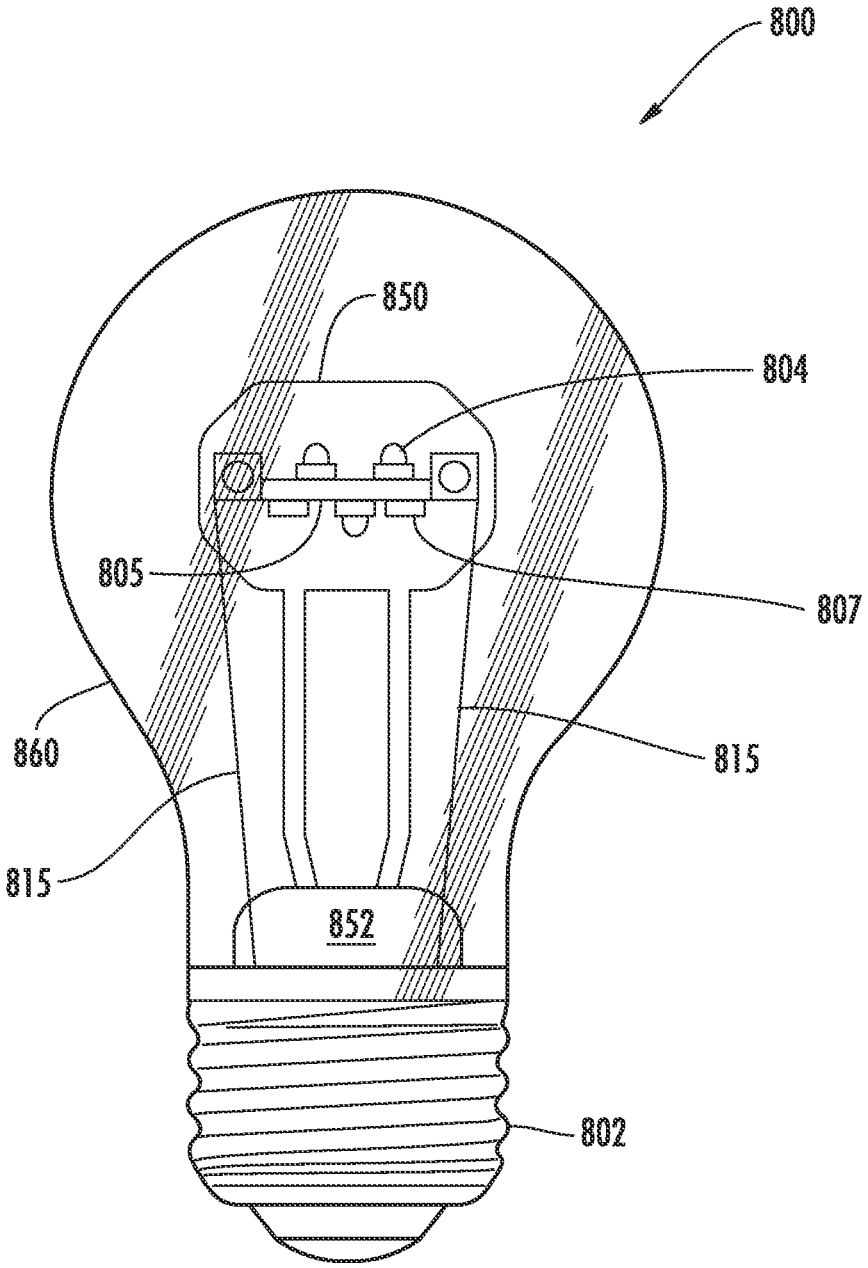

FIG. 8 is a "see-through" side view of a lamp, 800, according further embodiments of the present invention. Lamp 800 is an A-series lamp with an Edison base 802. In this case, LED packages 804 with their own lenses are mounted on a miniature circuit board 805. Circuit board 805 also includes power supply components 807. Circuit board 805 is connected to the contacts in Edison base 802 via wires 815, and the electrical connections to supply power to the LEDs in the LED array from the power supply are self-contained on circuit board 805.

Still referring to FIG. 8, inner envelope of lamp 800 includes a portion 850 that surrounds the circuit board and the LED array, and a portion 852 that serves as a fluid reservoir. The inner envelope is filled with an optically transmissive fluid that is also a phase change material and cools the LEDs and the driver by changing phases within portion 850 in response to heat. The fluid medium changes to a gas in portion 850 of the inner envelope and returns to liquid form in portion 852 of the inner envelope. In example embodiments, the phase change occurs at the hottest point in the lamp regardless of the orientation of the lamp, thus the phase change material will provide cooling regardless of how the lamp is positioned. Lamp 800 also includes an optically transmissive enclosure 860. The space between the optically transmissive enclosure 860 and the inner envelope of lamp 800 can be substantially or partially evacuated, be filled with air or an inert gas, or can be filled with an additional optically transmissive fluid medium. A phase change material cooling system could also be designed to make use of this space for condensation instead of the reservoir at the bottom of the lamp.

Various methods and techniques can be used to increase the capacity and decrease the size of a power supply, also sometimes called a "driver," in order to allow the power supply for an LED lamp to be manufactured more cost-effectively, or to take up less space in order to practically realize a lamp according to example embodiments of the invention. For example, multiple LED chips used together can be configured to be powered with a relatively high voltage. Additionally, energy storage methods can be used in the driver design. For example, current from a current source can be coupled in series with the LEDs, a current control circuit and a capacitor to provide energy storage. A voltage control circuit can also be used. A current source circuit can be used together with a current limiter circuit configured to limit a current through the LEDs to less than the current produced by the current source circuit. In the latter case, the power supply can also include a rectifier circuit having an input coupled to an input of the current source circuit.

Some embodiments of the invention can include a multiple LED sets coupled in series. The power supply in such an embodiment can include a plurality of current diversion circuits, respective ones of which are coupled to respective nodes of the LED sets and configured to operate responsive to bias state transitions of respective ones of the LED sets. In some embodiments, a first one of the current diversion circuits is configured to conduct current via a first one of the LED sets and is configured to be turned off responsive to current through a second one of the LED sets. The first one of the current diversion circuits may be configured to conduct current responsive to a forward biasing of the first one of the LED sets and the second one of the current diversion circuit may be configured to conduct current responsive to a forward biasing of the second one of the LED sets.

In some of the embodiments described immediately above, the first one of the current diversion circuits is configured to turn off in response to a voltage at a node. For example a resistor may be coupled in series with the sets and the first one of the current diversion circuits may be configured to turn off in response to a voltage at a terminal of the resistor. In some embodiments, for example, the first one of the current diversion circuits may include a bipolar transistor providing a controllable current path between a node and a terminal of a power supply, and current through the resistor may vary an emitter bias of the bipolar transistor. In some such embodiments, each of the current diversion circuits may include a transistor providing a controllable current path between a node of the sets and a terminal of a power supply and a turn-off circuit coupled to a node and to a control terminal of the transistor and configured to control the current path responsive to a control input. A current through one of the LED sets may provide the control input. The transistor may include a bipolar transistor and the turn-off circuit may be configured to vary a base current of the bipolar transistor responsive to the control input.

It cannot be overemphasized that with respect to the features described above with various example embodiments of a lamp, the features can be combined in various ways. For example, the various methods of including phosphor in the lamp can be combined and any of those methods can be combined with the use of various types of LED arrangements such as bare die vs. encapsulated or packaged LED devices, or with the use of phase change material. The embodiments shown herein are examples only, shown and described to be illustrative of various design options for a lamp with an LED array.

LEDs and/or LED packages used with an embodiment of the invention and can include light emitting diode chips that emit hues of light that, when mixed, are perceived in combination as white light. Phosphors can be used as described to add yet other colors of light by wavelength conversion. For example, blue or violet LEDs can be used in the LED assembly of the lamp and the appropriate phosphor can be in any of the ways mentioned above. LED devices can be used with phosphorized coatings packaged locally with the LEDs or with a phosphor coating the LED die as previously described. For example, blue-shifted yellow (BSY) LED devices, which typically include a local phosphor, can be used with a red phosphor on or in the optically transmissive enclosure or inner envelope to create substantially white light, or combined with red emitting LED devices in the array to create substantially white light. Such embodiments can produce light with a CRI of at least 70, at least 80, at least 90, or at least 95. By use of the term substantially white light, one could be referring to a chromacity diagram including a blackbody locus of points, where the point for the source falls within four, six or ten MacAdam ellipses of any point in the blackbody locus of points.

A lighting system using the combination of BSY and red LED devices referred to above to make substantially white light can be referred to as a BSY plus red or "BSY+R" system. In such a system, the LED devices used include LEDs operable to emit light of two different colors. In one example embodiment, the LED devices include a group of LEDs, wherein each LED, if and when illuminated, emits light having dominant wavelength from 440 to 480 nm. The LED devices include another group of LEDs, wherein each LED, if and when illuminated, emits light having a dominant wavelength from 605 to 630 nm. A phosphor can be used that, when excited, emits light having a dominant wavelength from 560 to 580 nm, so as to form a blue-shifted-yellow light with light from the former LED devices. In another example embodiment, one group of LEDs emits light having a dominant wavelength of from 435 to 490 nm and the other group emits light having a dominant wavelength of from 600 to 640 nm. The phosphor, when excited, emits light having a dominant wavelength of from 540 to 585 nm. A further detailed example of using groups of LEDs emitting light of different wavelengths to produce substantially while light can be found in issued U.S. Pat. No. 7,213,940, which is incorporated herein by reference.

With respect to the fluid medium used with an embodiment of the invention, as an example, a liquid, gel, or other material that is either moderate to highly thermally conductive, moderate to highly convective, or both, can be used. As used herein, a "gel" includes a medium having a solid structure and a liquid permeating the solid structure. A gel can include a liquid, which is a fluid. The term "fluid medium" is used herein to refer to gels, liquids, and any other non-gaseous, formable material. The fluid medium surrounds the LED devices in the optical enclosure. In example embodiments, the fluid medium is nonconductive enough so that no packaging or insulation is needed for the LED devices, although packaging may be included. In example embodiments, the fluid medium has low to moderate thermal expansion, or a thermal expansion that substantially matches that of one or more of the other components of the lamp. The fluid medium in at least some embodiments is also inert and does not readily decompose.

As examples, the fluid medium used in some embodiments of the invention can be oil. The oil can be petroleum-based, such as mineral oil, or can be organic in nature, such as vegetable oil. The fluid medium in some embodiments may also be a perfluorinated polyether (PFPE) liquid, or other fluorinated or halogenated liquid, or gel. An appropriate propylene carbonate liquid or gel having at least some of the above-discussed properties might also be used. Suitable PFPE-based liquids are commercially available, for example, from Solvay Solexis S.p.A of Italy. In embodiments where a phase change material is used for the fluid medium chloromethane, alcohol, methylene chloride or trichloromonofluoromethane can be used. Flourinert™ manufactured by the 3M Company in St. Paul, Minn., U.S.A. can be used as coolant and/or a phase change material. It should also be noted that water could be used as a phase change material, since pressure inside the relevant portion of lamp can be reduced in order to reduce the phase change temperature for water.

In at least some embodiments, the optically transmissive fluid medium is an index matching medium that is characterized by a refractive index that provides for efficient light transfer with minimal reflection and refraction from the LEDs through the enclosure. The index matching medium can have the same or a similar refractive index as the material of the enclosure, the LED device package material or the LED substrate material. The index matching medium can have a refractive index that is arithmetically in between the indices of two of these materials.

As an example, if unpackaged LEDs are used in a centralized LED array, a fluid with a refractive index between that of the LED substrates and the enclosure and/or inner envelope can be used. LEDs with a transparent substrate can be used so that light passes through the substrate and can be radiated from the light emitting layers of the chips in all directions. If the substrate chosen is silicon carbide, the refractive index of the substrates is approximately 2.6. If glass is used for the enclosure or envelope, the glass would typically have a refractive index of approximately 1.5. Thus a fluid with a refractive index of approximately 2.0-2.1 could be used as the index matching fluid medium. LEDs with a sapphire substrate can also be used. Since the substrate in this case would be an insulator, an ohmic contact would need to pass through the substrate of the LED if an un-packaged die is used. However, the refractive index of sapphire is approximately 1.7, so that in this case if glass is again used for the enclosure or envelope, the fluid medium could have a refractive index of approximately 1.6. If glass lenses are used on packaged LED devices, the fluid could have an index of approximately 1.5, essentially matching that of both the lenses and the enclosure.

The various parts of an LED lamp according to example embodiments of the invention can be made of any of various materials. A lamp according to embodiments of the invention can be assembled using varied fastening methods and mechanisms for interconnecting the various parts. For example, in some embodiments locking tabs and holes can be used. In some embodiments, combinations of fasteners such as tabs, latches or other suitable fastening arrangements and combinations of fasteners can be used which would not require adhesives or screws. In other embodiments, adhesives, screws, bolts, or other fasteners may be used to fasten together the various components.

Although specific embodiments have been illustrated and described herein, those of ordinary skill in the art appreciate that any arrangement which is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A lamp comprising:

an optically transmissive enclosure;

an array of LEDs disposed in the enclosure on a wire frame assembly with substantially no additional mechanical support, the array of LEDs being operable to emit light when the wire frame assembly is energized;

at least one, sealed inner envelope around the array of LEDs;

a liquid and/or gel to provide thermal coupling to the array of LEDs, at least one portion of the liquid and/or gel confined to the at least one inner envelop and at least another portion of the liquid and/or gel between the at least one inner envelope and the optically transmissive enclosure; and a phosphor suspended in either the liquid and/or gel confined to the at least one inner envelope or the liquid and/or gel between the at least one inner envelope and the optically transmissive enclosure.

2. The lamp of claim 1 wherein the liquid and/or gel comprises at least one of oil and fluorinated or halogenated liquid or gel.

3. The lamp of claim 2 wherein the liquid and/or gel provides optical coupling to at least one of the array of LEDs and the optically transmissive enclosure.

4. The lamp of claim 1 wherein the lamp takes one of a PAR and an A form factor.

5. The lamp of claim 1 wherein the lamp takes one of a PAR and an A form factor.

6. A lamp comprising:

an optically transmissive enclosure;

an array of LEDs disposed in the enclosure on a wire frame assembly, the array of LEDs further comprising at least a first die and a second die, and a phosphor associated with at least one of the first die and the second die;

at least one, sealed inner envelope around the array of LEDs; and an index matching medium contained in the enclosure to provide optical and thermal coupling to the array of LEDs;

wherein the first die, if illuminated, would emit light having a dominant wavelength from 435 to 490 nm, and the second die, if illuminated, would emit light having a dominant wavelength from 600 to 640 nm, and wherein the phosphor, when excited, emits light having a dominant wavelength from 540 to 585 nm and the lamp, when the array of LEDs is energized through the wire frame assembly, operates at a power level of at least about 5 watts.

7. The lamp of claim 6 wherein the index matching medium comprises at least one of oil and fluorinated or halogenated liquid or gel.

8. The lamp of claim 6 wherein the lamp takes one of a PAR and an A form factor.

9. The lamp of claim 6, wherein at least a portion of the liquid and/or gel is confined to the at least one, sealed inner envelope.

10. The lamp of claim 9 wherein the liquid and/or gel confined to the at least one, sealed inner envelope comprises phase change material.

11. A method of making a lamp, the method comprising:

providing an optically transmissive enclosure;

centrally locating an array of LEDs in the enclosure on a wire frame assembly, the array of LEDs further comprising at least at least a first LED and a second LED, wherein the first LED, if illuminated, would emit light having a dominant wavelength from 435 to 490 nm, and the second LED, if illuminated, would emit light having a dominant wavelength from 600 to 640 nm;

coating at least one of the first LED and the second LED with a phosphor wherein the phosphor, when excited, emits light having a dominant wavelength from 540 to 585 nm;

providing at least one, sealed inner envelope around the array of LEDs;

connecting the wire frame assembly so that the LEDs can be energized through the wire frame assembly to emit light; and placing an index matching medium in the enclosure so that the fluid medium provides optical and thermal coupling to the LEDs.

12. The method of claim 11 further comprising:

connecting a power supply to the wire frame assembly;

providing an Edison base; and connecting the Edison base to the power supply.

13. The method of claim 12 further comprising disbursing phosphor particles in the index matching medium.

14. The method of claim 13 wherein the phosphor particles are disbursed in the index matching medium inside the, sealed inner envelope.

15. The method of claim 14 further comprising placing the index matching medium both between the optically transmissive enclosure and the, sealed inner envelope and within the, sealed inner envelope.

16. The method of claim 12 wherein the index matching medium is confined to the, sealed inner envelope.

17. The method of claim 16 wherein the index matching medium is a phase change material.

18. The method of claim 16 further comprising providing a remote phosphor associated with the, sealed inner envelope.

19. A lamp comprising:

an optically transmissive enclosure;

an array of LEDs disposed in the enclosure to be operable to emit light when the array of LEDs is energized, the array of LEDs further comprising at least a first die and a second die, and a phosphor associated with at least one of the first die and the second die; and a phase change material contained in the enclosure to provide optical coupling to the array of LEDs and/or the optically transmissive enclosure and thermal coupling to the array of LEDs by changing to a gas in a portion of the enclosure that surrounds the array of LEDs and returning to a liquid in a fluid reservoir;

wherein the first die, if illuminated, would emit light having a dominant wavelength from 435 to 490 nm, and the second die, if illuminated, would emit light having a dominant wavelength from 600 to 640 nm, and wherein the phosphor, when excited, emits light having a dominant wavelength from 540 to 585 nm.

20. The lamp of claim 19 further comprising a supporting power structure connected to the array of LEDs.

21. The lamp of claim 20 wherein the lamp takes one of a PAR and an A form factor.

22. The lamp of claim 19 further comprising at least one inner envelope wherein at least a portion of the phase change material is confined to the at least one inner envelope.

* * * * *